United States Patent [19]

Kümmerl

[11] Patent Number: 4,544,253

[45] Date of Patent: Oct. 1, 1985

[54] CONVEYING SYSTEM FOR PASSING PHOTOGRAPHIC LAYER-BEARING CARRIERS OF STRIP OR SHEET FORM THROUGH THE PHOTO CHEMICAL BATHS OF A DEVELOPING APPARATUS

[76] Inventor: Hermann Kümmerl, Kasseler Strasse 17, D-8500 Nuremberg 20, Fed. Rep. of Germany

[21] Appl. No.: 541,663

[22] Filed: Oct. 13, 1983

[30] Foreign Application Priority Data

Feb. 22, 1983 [DE] Fed. Rep. of Germany ..... 3306139

[51] Int. Cl.[4] ..... G03D 3/13

[52] U.S. Cl. ..... 354/321; 226/186; 226/190

[58] Field of Search ..... 354/316, 319, 320, 321, 354/322; 226/108, 186, 189, 190, 191; 29/113 R, 121.1, 122, 124

[56] References Cited

U.S. PATENT DOCUMENTS

| | | | |
|---|---|---|---|
| 3,078,024 | 2/1963 | Sardeson | 226/189 |
| 3,345,928 | 10/1967 | Krehbiel | 354/316 |
| 3,847,260 | 11/1974 | Fowler | 226/191 |
| 3,989,176 | 11/1976 | Hope et al. | 226/189 |

FOREIGN PATENT DOCUMENTS

| | | | |
|---|---|---|---|
| 2947204 | 5/1981 | Fed. Rep. of Germany . | |
| 1316203 | 5/1973 | United Kingdom | 354/320 |
| 1393566 | 5/1975 | United Kingdom | 354/320 |

*Primary Examiner*—A. A. Mathews

*Attorney, Agent, or Firm*—Spencer & Frank

[57] ABSTRACT

An apparatus for conveying photographic layer-bearing carriers in the shape of webs or sheets through photochemical baths of developing machines, with passages for the layer-bearing carriers open between one or several pairs of transport rollers, some of which are driven, and providing a passage gap for the layer carriers between conveying rollers being elastically resilient in a direction radial with regard to the roller shaft. In order to guarantee a truly unobjectionably developed product, with the minimum possible of assembly and maintenance costs, the roller which is destined to make contact with the uncoated reverse side of a layer-bearing carrier is a roller of variable cross-sectional area, having a number of radially yielding contact elements arranged side by side on the roller shaft, which elements are disc-shaped lamellae or mushroom-shaped lamellae the peripheries of which are directed toward the second or external roller of a roller pair, or are in contact with the peripheral wall of the last-mentioned roller.

14 Claims, 6 Drawing Figures

CONVEYING SYSTEM FOR PASSING PHOTOGRAPHIC LAYER-BEARING CARRIERS OF STRIP OR SHEET FORM THROUGH THE PHOTO CHEMICAL BATHS OF A DEVELOPING APPARATUS

BACKGROUND OF THE INVENTION

The invention relates to a conveying system for passing web- or sheet-shaped photographic layer-bearing carriers through the photochemical baths of a developing apparatus in which the layer-bearing carriers are passed through between at least one pair of parallel conveying rollers, at least one of the rollers of each pair is a driven one, and the passage gap of a roller pair for the layer-bearing carriers is elastically resiliently enlargeable in a direction perpendicularly to the shafts of the rollers of that pair.

Nowadays, hobby photographers as well as professional photographers do no longer carry out the developing, rinsing and fixing steps of their processing of exposed photographic paper manually, but this is now done with the aid of more or less completely automated developing machines into which the exposed photographic material is introduced and in which it undergoes the various known developing stations. The transportation of the papers through the machine is usually carried out by means of pairs of so-called conveying or transport rollers, wherein the photographic paper is passed by friction through a passage gap between every two conveying rollers being in engagement with one another. At least one of the two rollers of each pair is a driven one, and the passage gap is adapted to be resiliently enlarged to a small degree to be adapted to the thickness of the photographic layer-bearing carrier. The property of the passage gap being resiliently enlargeable is of particular importance in the developing process because an excessively high roller pressure on the light-sensitive layer is liable to have a negative influence on the developing process. On the other hand, a certain minimum of roller pressure is needed as, firstly, a secure guidance of the slippery paper material passing between the conveying rollers must be safeguarded if an obstruction in the movement of paper through the apparatus is to be avoided, and, secondly, a certain squeezing off of the residual potassium bromide solution left on the upper side of the developed layer during the developing process is to take place. Moreover, it is important that roller pressure is always applied substantially uniformly, as, otherwise, there may be obtained streaky differences in the appearance of the developed products.

In the known apparatus this enlargeability of the passage gap has been achieved by different modes of construction:

(a) For a considerable length of time, polyvinyl chloride rollers have been in use as the afore-mentioned conveying rollers and have been satisfactory in certain aspects because of their chemical resistance. However, the manufacture of these rollers is relatively expensive as they require very exact finishing, on account of the hardness of their material, in order to attain a true rotation and to avoid pressure fluctuations between the rollers during rotation.

A resilient support for these hard rollers was achieved by providing at least one roller of each pair of rollers with a slotted hole bearing, and resiliently pressing the two rollers together by means of a coil spring or leaf spring. However, coil springs have the fundamental drawback that, over a certain length of time, residues of developer chemicals will be deposited in the spring bodies so that the springs are progressively prevented from "breathing", i.e. contracting and expanding. Leaf springs have not been found to have a long life because the corroding influence of chemicals in the development baths cause the spring material to lose its elastic properties and become brittle. Bearings using springs have been found to be, in the long run, costly in production, assembly and maintenance.

(b) Rubber rollers have also been in use for some time as conveying rollers. Due to their softness, rubber rollers have the advantage that complicated spring equipment for their bearings is not indispensible. Yet, it has been found that the production of rubber rollers is also not free from problems, as rubber is not as resistant to chemicals as polyvinyl chloride. Indeed, rubber mixtures have been developed in the past which possess adequate chemical resistance to photochemical baths. But even these types of rubber rollers suffer from certain drawbacks, as the resilience of the rubber mixtures in question is limited, and they are subject to a certain swelling process in the development baths which cannot be controlled in a desired manner. This swelling can lead to an increase of the roller diameter of from about one tenth to two tenths of a millimeter, a range which can have a negative influence on the contact pressure between the paper and the roller, and thereby on the developed product, in particular if it is undesirable to make very high demands on the tolerances of the roller bearings.

(c) Other known apparatus use conveying rollers bearing a textile coating which possesses certain resilient properties. This textile coating suffers, however, from a serious drawback, namely, that residues of developer chemicals are deposited in the same, and these residues on the rollers will, in the long run, have a negative influence on the results of the development process. In order to keep this negataive influence as small as possible the textile coating should be replaced within a period of from three to four months, which requires a considerable investment of time in their maintenance; for conveying racks must be completely dismantled to this end.

(d) Finally, there must be mentioned so-called foam rollers used as conveying rollers which have the same negative properties as the textile-coated rollers. A particularly negative influence of the foam rollers does, however, reside in their absorption properties; for, when a rack bearing such rollers is taken out of a bath, a considerable amount of bath solution is removed from the tank containing the same. It may take a whole day for the rollers to dry after they have been taken out of the bath, i.e., until all residual liquid has dripped off from the rollers. Moreover, it is relatively difficult to clean the foam rollers. Last not least, there should be mentioned the high weight of the liquid-saturated rollers which are to be removed together with the rack from the tank. A fully saturated roller is so heavy, weighing some tens of kilograms, that a small gantry crane is needed to lift the rack out of the tank.

OBJECTS AND SUMMARY OF THE INVENTION

Objects of the invention are to provide a conveying system of the initially described type, for use in developing machines, which can be manufactured in a simple manner and at low cost and which is easy to maintain in operative condition, while affording a high quality of the developed products over prolonged periods.

These objects are attained in accordance with the invention by a conveying system of the initially described type, in which a first roller of a roller pair, which roller is destined to contact the uncoated back side of a layer-bearing carrier, is of variable diameter, and comprises a roller shaft and a number of pressure elements rotatably mounted, one besides the other, on the roller shaft, and being resiliently yielding in radial direction with regard to the roller shaft, and being directed with their peripheries toward or into contact with the peripheral surface of a second roller of the said pair. The pressing elements can be laminate discs or hat-shaped elements having a convex and a concave side, the cavity of the latter opening in axial direction with regard to the roller shaft. This first roller can be, for instance, the central roller and the second roller can be one of the two outer rollers in a three-high (trio) roller arrangement.

The invention thus provides, in the novel conveying system, first of all, a conveying roller which engages the paper being conveyed in an extraordinarily gentle manner and guarantees a continuously uniform contact pressure over the entire length of the roller, thanks to the individually radially yielding resilient pressure elements.

Each of these elements acts by itself, as an isolatedly rotating spring element which is axially uncoupled from the other pressure elements, so that eccentricities in the rotary movement of the roller will not have any noticeable effect on the pressure exerted by the roller on the paper. Also, the resilient effects are not limited to any defined direction as it would occur in the case of hard rollers whose shafts are supported in slotted bearing holes, for the peripheral areas of the elements cooperating with the paper can fit snugly and softly on the paper surface adapting to any curved portions thereof, without subjecting the paper to any hard lines of pressure load between the rollers.

Moreover, the rollers according to the invention allow, for the first time, the construction of conveying racks permitting a greatly increased liquid flow rate therethrough, a fact which has an extremely positive effect on the results of the development of the exposed material. For it is advantageous when the bath solution can circulate in the tank and act on the photochemical layer as far as possible with as few obstacles as possible.

The disc-shaped lamellae afford a particularly satisfactory straight aligned guidance of the photographic paper, as if running on tracks, especially when the lamellae are disposed in parallel next to each other, thereby avoiding obstructions to occur within the rack that would lead to an accumulation of paper.

A positive effect on the liquid flow rate through each roller group and on the circulation of the liquid in the tank is achieved by mounting some of the lamellae at an acute angle with the roller shaft. These obliquely positioned lamellae "paddle" in the liquid during rotation of the roller, so that the liquid in the immediate vicinity of the photographic layer is in constant motion.

An embodiment of a lamellae-bearing roller which is particularly simple to construct and advantageously supported in a rack is achieved by a lamellae roller having a roller core of preferably constant diameter, and by the laminate discs being perforated discs sitting on the roller core and affixed thereon in position by means of spacer discs of lesser diameter.

According to another embodiment, the pressure elements can be elastic, radially deformable hollow bodies, for instance hat- or mushroom-shaped laminae, which can be mounted next to one another on the shaft core of the roller, be it individually, or in groups of several close together. These hollow elements can be caused to yield elastically in a spring-like deformation. While, in the case of disc-shaped laminae, it is not certain at the beginning of deformation, whether they will form a passage gap by deflection to one side or the other, or by upsetting the disc wall, a hollow body has at least one wall section thereof, which does not extend perpendicularly to the roller shaft axis and thus can be elastically resiliently deformed by decreasing the angle it forms with the roller shaft axis, thus affording a particularly soft radial resiliency, which can be further increased by providing in the hollow body a number of slits which extend preferably at a right angle to the shaft core axis.

In another embodiment which is particularly simple to manufacture, the hollow bodies are devised as hemispherical or conical lamellae having a cavity opening in axial direction out of one side thereof, with this lamella side extending at approximately a right angle to the shaft core axis.

It is an advantage of this embodiment that pressure elements having the shape of a half shell or of a hemispherical calotte will not retain the bath solution in their cavities when the rack containing them is lifted out of the bath solution. Moreover, the manufacture of an injection mold as tool for the production of these lamellae can be carried out at relatively low cost, so that mass production of these lamellae will supply them at a favorable price.

In order to be able to utilize the entire wall region of these mushroom- or hat-shaped laminae during a soft resilient deformation, these elements are fastened on the roller shaft core on the solid side thereof axially opposite that side out of which the above-mentioned cavity opens. This is done advantageously by providing a bushing or sleeve being an integral part of the solid lamella side and extending axially through and out of the said cavity, this bushing or sleeve being seated with tight fit on the shaft core. A number of this kind of hat-shaped lamella can also be strung up in series on a shaft core, in a simple operation that can be carried out by an industrial robot, as only elements having identical configuration and dimensions need to be pushed on to the shaft core, which elements, thanks to their characteristic configuration, can be easily prealigned by such industrial robot.

It is particularly advantageous to use polyethylene for the production of these hollow elements, because such elements besides showing a satisfactory resilience when their respective walls are kept correspondingly thin, are resistant to all known photochemical baths, and, in particular, the undesirable swelling need not be feared which occurs when using rubber rollers.

As the resilient inward bending of the peripheral portions of the hat- or mushroom-shaped pressure elements is accompanied by a slight axial displacement of their lateral portions, it is of advantage to mount all of these elements on a common shaft in such a manner that half their number face with the open ends of their cavities toward one end of the shaft, and the other half toward the other shaft end. This can be achieved in different ways, for instance by arranging groups of vicinal elements with their cavity facing toward the same shaft end, whereby the peripheral wall of one is bent inwardly toward the closed sidewall of the other, or by arranging pairs of two vicinal elements the concave sides of which are turned toward each other, or the left half of the roller shaft bears the hat-shaped elements with their concave side facing toward the left shaft end, while the right half of the shaft bears the hat-shaped elements thereon with their concave sides facing toward the right shaft end; or viceversa. What is essential in these various arrangements is that the number of elements facing with their concave sides in one direction is equal to the number of elements whose concave sides face in the opposite direction whereby the forces of axial displacement acting in the two groups of elements are balanced.

In order to further increase the flexibility of the individual pressure elements, such as discs or hat- or mushroom-shaped laminae, it can be advantageous to provide annular zones with resiliently elastic folds to form bellows-type configurations which permit an accordion-type deformation or axial displacement of the hat portions of these elements.

In a preferred embodiment of the conveying system according to the invention, as mentioned hereinbefore, the radially deformable, in particular compressible roller is the central roller of a three-high roller system in which the shafts of the three rollers should preferably be arranged in parallel, and can be arranged in one and the same plane, with the distance of the shafts of the second and third rollers, as the external rollers of the trio, supported at a constant distance from one another, e.g., in a rigid frame or rack.

This is of particular advantage because the fact that the pressure elements of the central roller can be deformed in several radial directions simultaneously permits this central roller to control at the same time the width of the two gaps between the deformable outer face of the central roller and the two rigid faces of the two external rollers of the trio-roller arrangement.

Particularly space-saving are the arrangements in which the two ends of the roller shafts (shaft cores) are supported in bearings provided in the frame of a conveying rack which is immersible in a bath tank.

In a preferred embodiment, a plurality of roller trio units are stacked one above the other, each such trio unit comprising a radially elastically deformable central roller, and all of the units are supported in a rack serving for conveying photographic layer-bearing carriers along a U-shaped path through a photochemical bath.

The property of the rollers according to the invention which permits deformation of portions of the roller surface in each and every radial direction, with regard to the roller shaft, and all at the same time, is of particular advantage when such radially deformable roller comprising pressure elements of the type described hereinbefore is arranged as the central reversing roller at a closed end of the U-path, preferably at the closed bottom end of the latter, in the rack, and when this central deformable roller is surrounded, in a U-shaped arrangement of wider diameter, by a plurality of peripherally disposed external guide rollers whose shaft axes are rigidly located in the rack.

In order to achieve a safe guidance of the layer-bearing carriers from one passage gap therefor to the next following one, guiding elements are used which support the carriers in the transitional zones between the conveying units comprising each two or three conveying rollers.

In the known devices, these guiding elements are devised as sheets of metal which can extend only across the interspace between the pairs of rollers which are preferably superimposed one above the other.

In the conveying system according to the invention it is now possible to provide guiding elements which extend advantageously through one or several passage gaps, so that it becomes practically impossible that paper edges will get caught at corners or the like of the guiding elements. Moreover, these guiding elements further facilitate the liquid flow through the rack.

More in detail, at least one guiding element for guiding the paper edges which extend transversely to the direction of transportation of the paper through the rack is devised as a rod which extends in a plane transversely to the axes of the shafts of a central roller in a rack, through the gaps between two adjacent pressure elements on the central roller shaft.

Thus the rod can be provided as guiding element between two central rollers of two three-high roller sets adjacent one another; or it can also be devised as a long guiding rod extending through such gaps between adjacent pressure elements of all the central rollers mounted in a rack which gaps are aligned with one another in the aforesaid transverse plane. Preferably each central roller bearing resiliently axially deformable pressure elements such as flat lamella discs or hat- or mushroom-shaped pressure elements is traversed by at least two such guiding rods, one through the left-hand half and the other through the right-hand half of the central roller.

These two guiding rods can be devised as an integral U-shaped guiding element the legs of which represent guiding rods extending parallel with one another through interstices between adjacent pressure elements of all central rollers in a common rack, and the closed end of the U-shaped guiding element can be fastened to a cross bar provided in the rack at one end thereof and extending parallel to the roller shafts in the rack.

A particularly gentle handling of the paper material passing through the rack is achieved by providing, in each three-high roller assembly, a gear train connecting each of the three rollers in such an assembly with one another, on one side of the rack, and, on the opposite side of the rack, gear drive means or sprocket-and-chain drive means for operating the rollers in all of the trio assemblies in the rack in unison and in a slip-free manner. For, rollers driven free from slippage cause less friction and abrasion on the paper than loose rollers or rollers driven with a degree of irregular slippage. The distribution of driving means on the two opposite sides of the rack is particularly advantageous as it helps to balance forces of stress on the rack. The resulting more even distribution of the weight of the rack also helps to avoid canting the rack when it is lifted in the tank, and thus to prevent sensitive drive elements to hit against the tank sidewalls.

Preferably, a uniform advancing force is applied to both sides of the paper being conveyed in the rack over the entire length of the conveying path; this will avoid the stoppage of paper movement along that path especially in the critical transport direction-reversing U-shaped region thereof at the lower end of the rack. For this purpose, the central reversing roller bears on its reversing shaft toward one end of the latter a sun wheel, and the guiding rollers surrounding the sun wheel in approximately a semicircle being the closed end of the U-shaped path are mounted for rotation about their rigidly stationary axes on shafts which bear at their ends planet gears being in driving engagement with the aforesaid sun wheel of the central reversing roller.

According to another feature of the conveying system according to the invention, the shaft of the pressure elements-containing central roller of a trio roller set, destined for engaging the uncoated rear side of the paper carrier being conveyed through a rack, is positioned in the rack so as to slightly precede, in the direction of paper transportation, the shaft of the respective external roller destined for engaging the photographic layer-bearing side of the paper carrier.

This causes the leading edges of the paper material being conveyed to leave the passage gap between the thus positioned rollers with a slight inclination, in the direction of paper transportation, toward the guiding elements, whereby these leading paper edges are caused to slide along these guiding elements at a flat angle and are safely introduced into the next following passage gap.

That upper region of the rack which is situated during operation above the level of the bath solution has the tendency to become soiled and incrusted by residues of splashing liquid much more rapidly than the rack parts below the level of the liquid. In order to avoid the necessity to remove the entire rack from the tank solely for the purpose of cleaning the upper rack part, the latter part is designed to be detachable from the remaining lower part of the rack.

The separable joint between the upper and the lower rack part is advantageously devised to run approximately horizontally between the uppermost trio roller set and the deflecting rollers thereabove, serving for deflecting the paper material being conveyed into the rack from a horizontal path to a vertically downwardly directed path of paper transportation. The deflecting rollers are thus located in the ambient air. In order to guarantee an exact entry of the paper material and its exact travel through the entire conveying device, the upper part and the lower part of the rack are secured together, for instance by a bolt-and-nut connection and/or other conventional means such as a notch-and-cam engagement.

BRIEF DESCRIPTION OF THE DRAWINGS

Other objects and advantages which are obtainable by the conveying system according to the invention will become apparent from the further description of preferred embodiments thereof illustrated in the accompanying drawings in which.

DETAILED DESCRIPTION OF THE EMBODIMENTS SHOWN IN THE DRAWINGS

Figures 1, 6:
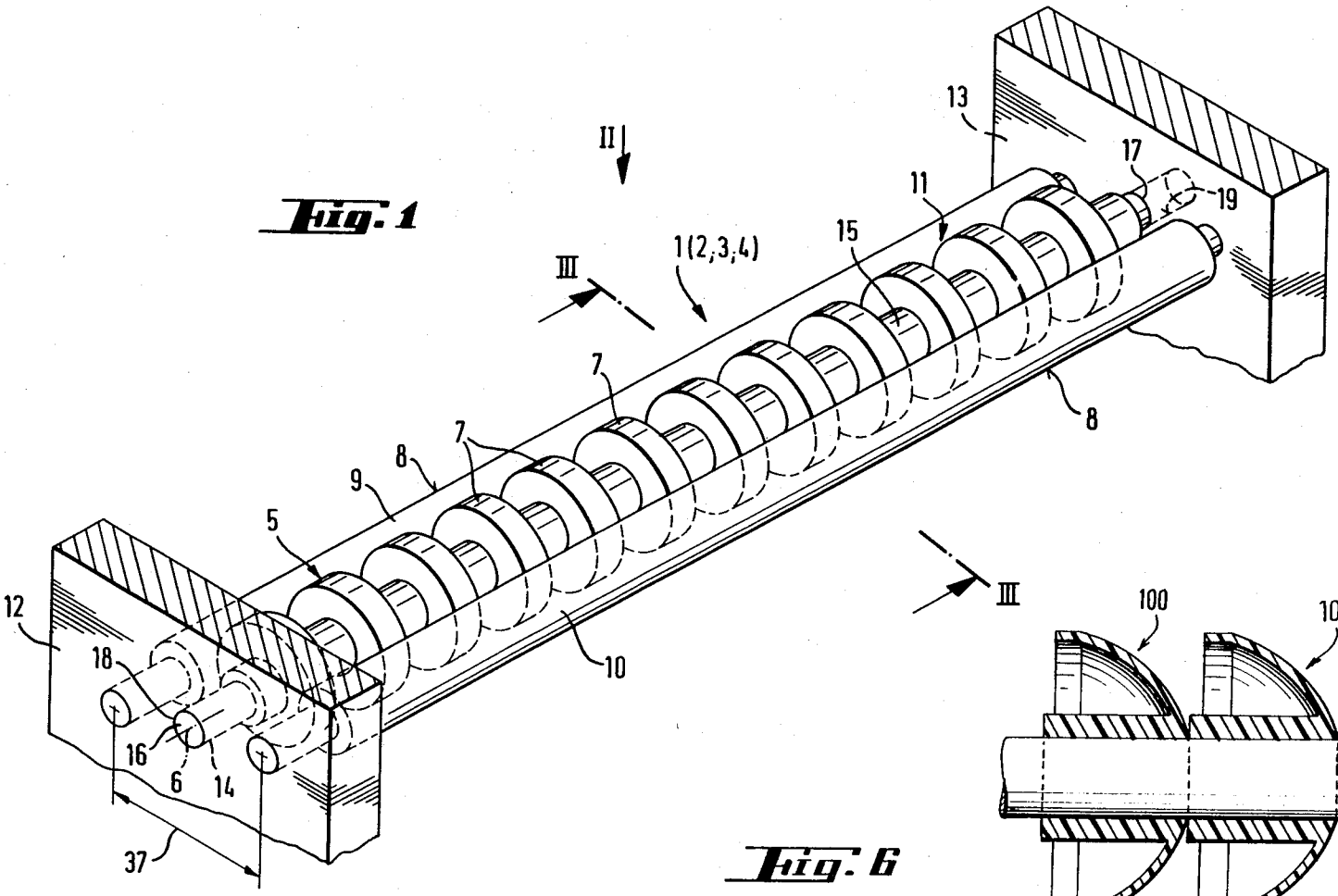
FIG. 1 shows in perspective view a first embodiment of a trio roller arrangement according to the invention, the central roller of which is a lamella disc roller.
FIG. 6 is a similar view as in FIG. 5, but with the pressure elements being configured differently.

The conveying system according to the invention for conveying web- or sheet-shaped photographic layer-bearing carriers comprises in its interior a plurality of parallel conveying rollers, four three-high roller sets 1, 2, 3 and 4 having each three rollers whose shafts are located in one and the same plane, the roller destined to come into contact with the uncoated reverse side of the carriers being devised as a lamellae-carrying roller 5. Such roller 5 is equipped with a plurality of elastically resilient lamella discs 7, the peripheral faces of which project from the roller shaft 6 toward the external rollers 9, 10 or contact their surfaces 8. Between the lamellae-bearing roller 5 and the external rollers 9, 10 there are left gaps 11 for the passage of the photographic layer-bearing carriers. The outer rollers 9, 10 are supported at a fixed distance from one another in lateral rack frame parts 12 and 13. This distance is designated by 37.

The lamellae-carrying roller 5 has a shaft core 14, and the disc-shaped lamellae 7 are devised as flat perforated discs being mounted on the core 14, and fixed in position thereon by means of spacer discs 15 of smaller diameter which are disposed between the disc-shaped lamellae 7. The ends 16 and 17 of the shaft core 14 are supported for rotation in bearings 18, 19 of the lateral frame parts 12 and 13 of the rack.

The reversing roller 21 which is provided centrally in the lower arcuate track of the U-shaped path of transportation 20 in the rack is also devised as a lamellae-bearing roller, and is surrounded by a number of guiding rollers 22 which are firmly supported with their shafts extending in a U-shaped plane and parallel with each other.

The guiding rollers 22 can also be of the lamella type, but the lamellae need not be radially resilient. A short axial shift of a lamellae-bearing roller shaft relative to the shafts of the next-preceding and next following lamella rollers 22 permits the lamellae of the shifted guiding roller to dip into the interspaces between the lamellae of the two neighboring rollers so that a blockage of paper is avoided.

In order to guide the leading paper edges which extend transversely to the direction of their transportation, there is provided a number of guiding elements 23 in the shape of elongated rods which extend through the roller periphery defined by the diameter 24 of the lamellae-bearing roller 5.

Figure 3:
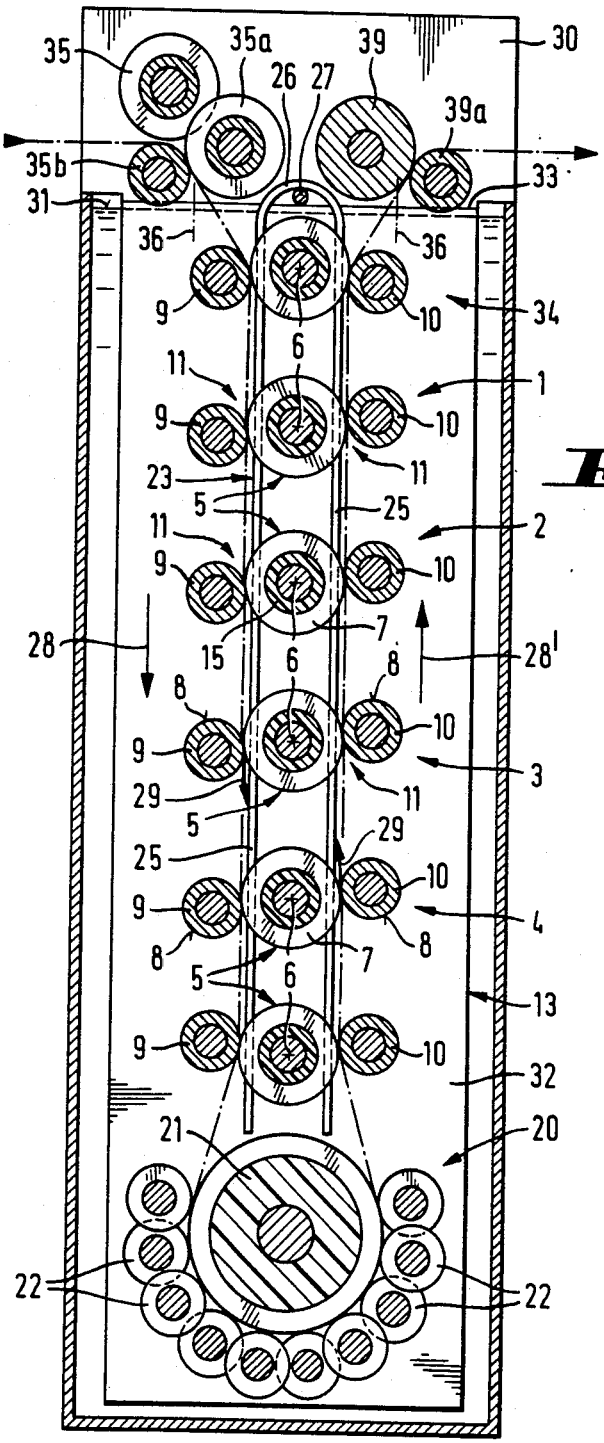
FIG. 3 is a schematic representation of a preferred embodiment of the conveying system according to the invention.

In FIG. 3 there are shown a number of trio roller sets arranged above each other, and a U-shaped guiding element 25–26 is so arranged that one of the legs 25 traverses the circumferences of the central rollers 5 on the left-hand side of the trio sets, while the other leg 25 of the U-shaped element traverses the circumference of the central rollers 5 on the other side thereof, and the closed head portion 26 of the U-shaped element is fastened to a cross bar 27 which is mounted in the rack frame and extends parallel with the rollers.

All guiding rollers of the rack are driven rollers. The drive within a trio roller set is effected, e.g. between the two external rollers and the central roller by gear means (not shown) which are located, for instance, at the lateral rack frame portion 12.

The drive transmission from one of the trio roller sets to the others is effected by gear or gear chain drives which, for reasons of weight balance, are arranged on the outside of the other lateral rack frame portion 13.

The drive of the guiding rollers is effected by means of planet pinions which are driven from a sun wheel which is mounted on the shaft of the lower lamellae-bearing roller 21 which serves as a conveying direction-reversing roller. The driving gears and gear chains are not shown in the drawings as their arrangement is conventional.

The planes in which the shafts of the three rollers of each trio roller set are located, are so inclined with regard to the main direction of transportation 28, 28' that the external rollers 9, 10 follow the central rollers 5 in the direction of paper transportation, whereby the leading paper edge leaves the passage gap of each trio roller set with a slight bend toward the guiding element 23 (arrow 29).

The upper rack part 30 which is located above the liquid level 31 can be separated from the lower part 32 along a joint 33 which extends approximately horizontally between the uppermost trio roller set 34 and the guide rollers **35*b* and 39*a*** of the paper entry and discharge, respectively.

At the entry side, in the upper part 30 of the rack there are arranged lamella-bearing rollers 35 and **35*a* which are of similar construction as the rollers 5, and the roller 35*b* having a smooth surface, of a construction similar to that of rollers 9 and 10. These rollers 35, 35*a* and 35*b*** serve to guide and convey the paper during its entry into the apparatus.

At the exit side of the upper rack part 30 there are provided guiding and conveying rollers 39 and **39*a***.

A bolt connection which is only indicated schematically serves to keep the upper part 30 and the lower part 32 of the rack properly aligned during operation.

Figure 4:
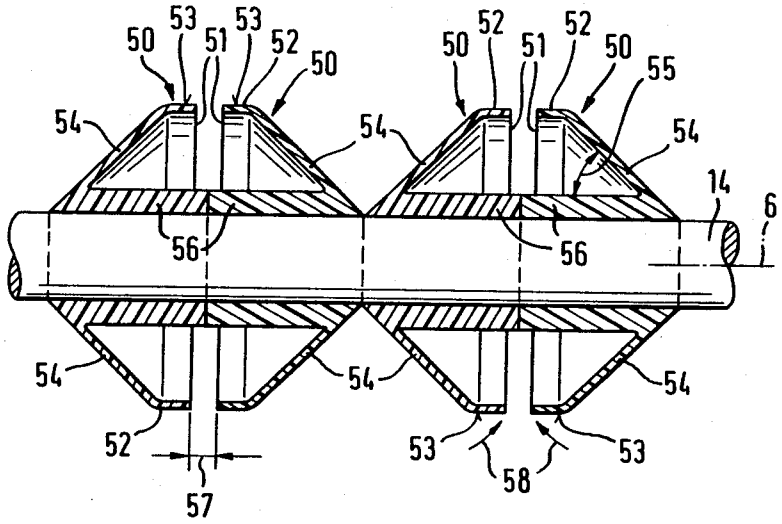
FIG. 4 is a schematic axial, partly sectional view of a length of roller shaft core bearing four resilient mushroom-shaped pressure elements.

In FIG. 4, a section of a roller shaft or core 14 having a longitudinal shaft axis 6 bears mushroom-shaped pressure elements 50 of which four are shown, which elements are of mushroom shape, with the hats 54 of the "mushrooms" having open undersides 51. The elements 50 are arranged on the shaft 14 in pairs having the hat undersides 51 of the two elements 50 of each pair facing toward each other.

The rims of the undersides 51 extend in planes perpendicular to the roller shaft axis 6. The hat portions 54 of these elements 50 have at their periphery a substantially cylindrical portion 52 whose outer surface 53 extending in axial direction constitutes the supporting face to be contacted by the underside of the photographic paper. This peripheral cylindrical portion 52 merges with a conical wall portion 54 having an angle 55 of about 45° relative to the roller shaft axis 6. The conical wall portion 54 is integral with a bush 56 which constitutes the "stem" of the "mushroom" and extends slightly beyond the rim of the open underside 51 of the cylindrical portion 53, whereby there is a gap 57 between the rims of the cylindrical portions 53 of adjacent elements 50 in a pair, which gap 57 permits spring-like-deformation of the elastically resilient portions 51 and 54 of the adjacent elements 50 yielding to radial pressure exerted on the peripheries of the lamellae S0 as indicated by a pair of arrows 58.

Figure 5:
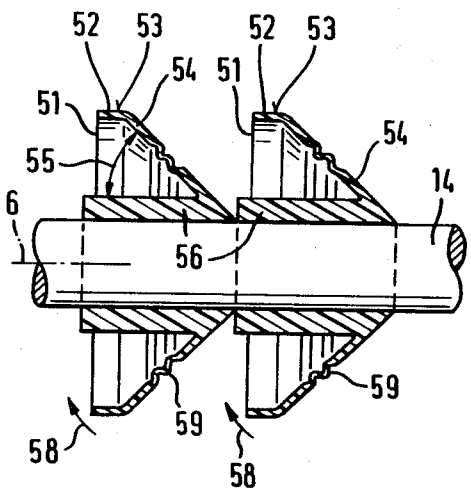
FIG. 5 is a similar view as in FIG. 4, but with the shaft core bearing two similar pressure elements in a different arrangement, and with accordion-shaped annular zones.

In FIG. 5 there is shown a different mutual arrangement of two of the mushroom-shaped lamella elements 50. Instead of having their open hat undersides 51 turned toward each other, they all open in the same axial direction.

In this case, care must be taken that the lamella elements at the opposite end of the roller shaft 14 have their open undersides 51 facing in the opposite direction.

Figure 2:
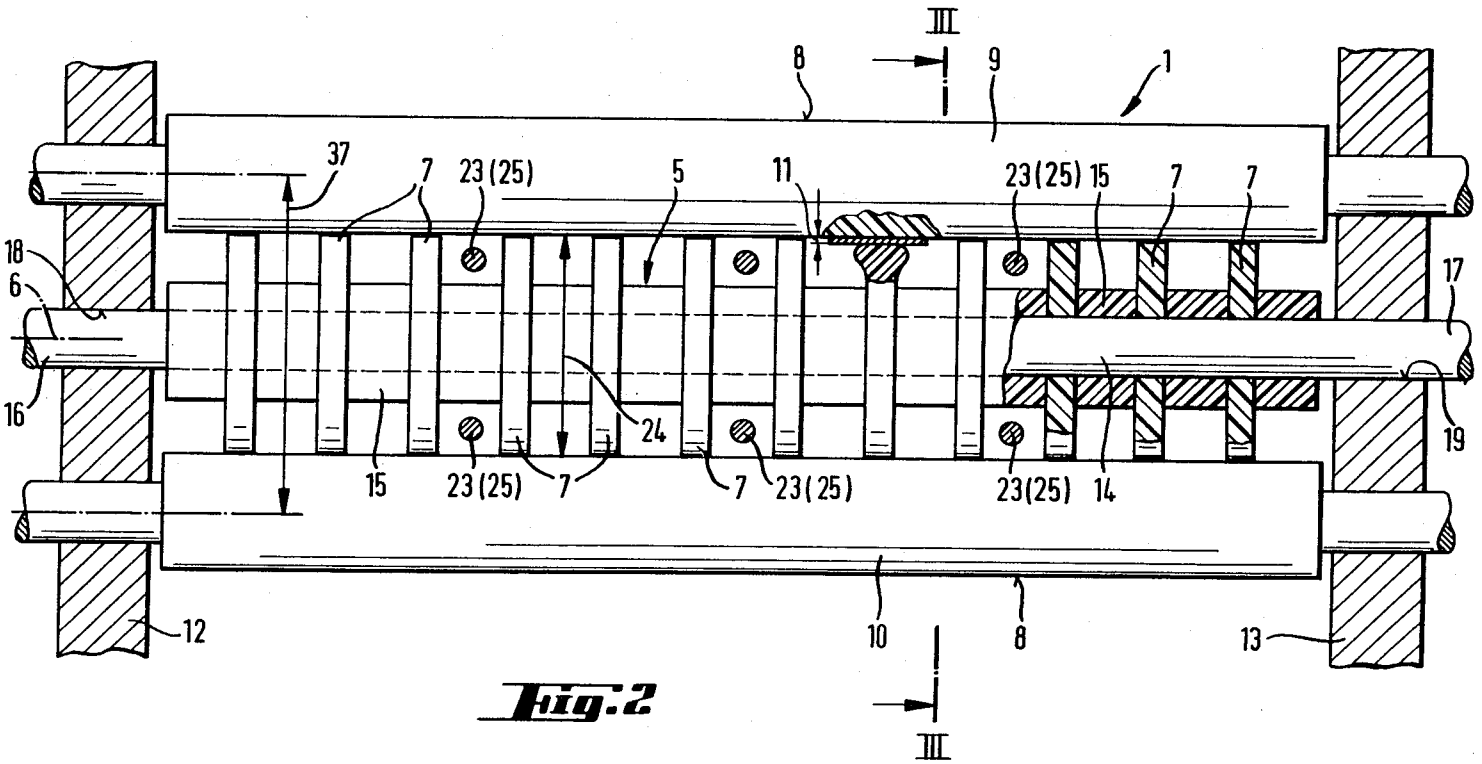
FIG. 2 is a partly sectional top plan view of the embodiment shown in FIG. 1.

Furthermore, in the embodiment shown in FIG. 5, an accordion-type annular zone 59 is provided in the wall of the conical hat portion 54. Such zone can, of course, be likewise provided in the disc-shaped lamellae 8 (FIG. 2).

The lamella elements may also have portions configured as hemispheres, as illustrated by elements 100 in FIG. 6.

I claim:

1. A conveying system for passing a web- or sheet-shaped photographic layer-bearing carrier along a path through the photochemical baths of a developing apparatus, the carrier having an uncoated side, comprising:

at least one set of parallel conveying rollers, at least one roller of each set being driven, each set of rollers including a first roller having a first shaft and a peripheral surface, and a second roller having a second shaft and a plurality of pressure elements rotatably mounted one behind the other on said second shaft, said elements being resiliently yielding in the radial direction with regard to said second shaft, each element having a first portion with a convex side, a concave side with a cavity therein that is open in the axial direction relative to said second shaft, and a periphery that is directed toward said peripheral surface of said first roller, wherein said first and second rollers are disposed on either side of said path and resiliently engage a carrier moving along said path, with the uncoated side of the carrier facing said second roller, to provide a carrier passage gap between said first and second rollers, the dimension of said gap along a line perpendicular to said first and second shafts being changeable to accommodate carriers having different thicknesses, and wherein each of said pressure elements is of mushroom-shaped configuration and further comprises a second portion configured as central bush adapted for being mounted on said second shaft.

2. The conveying system of claim 1, wherein said bush projects from said cavity on the open side thereof, thereby, when at least two of said pressure elements are mounted in parallel on said second shaft, spacing said first portions of adjacent pressure elements from each other sufficiently to permit inward deflection of said first portions.

3. A conveying system for passing a web- or sheet-shaped photographic layer-bearing carrier along a path through the photochemical baths of a developing apparatus, the carrier having an uncoated side, comprising:

at least one set of parallel conveying rollers, at least one roller of each set being driven, each set of rollers including a first roller having a first shaft and a peripheral surface, and a second roller having a second shaft and a plurality of pressure elements rotatably mounted one behind the other on said second shaft, said elements being resiliently yielding in the radial direction with regard to said second shaft, each element having a first portion with a convex side, a concave side with a cavity therein that is open in the axial direction relative to said second shaft, and a periphery that is directed toward said peripheral surface of said first roller, wherein said first and second rollers are disposed on either side of said path and resiliently engage a carrier moving along said path, with the uncoated side of the carrier facing said second roller, to provide a carrier passage gap between said first and second rollers, the dimension of said gap along a line perpendicular to said first and second shafts being changeable to accommodate carriers having different thicknesses, and wherein said first portion comprises a conical wall section being inclined relative to said second roller at an angle of about 45°.

4. The conveying system of claim 3, wherein at least said first portions of said pressure elements are of polyethylene.

5. A conveying system for passing a web- or sheet-shaped photographic layer-bearing carrier along a path through the photochemical baths of a developing apparatus, the carrier having an uncoated side, comprising:

at least one set of parallel conveying rollers, at least one roller of each set being driven, each set of rollers including a first roller having a first shaft and a peripheral surface, and a second roller having a second shaft and a plurality of pressure elements rotatably mounted one behind the other on said second shaft, said elements being resiliently yielding in the radial direction with regard to said second shaft, each element having a first portion with a convex side, a concave side with a cavity therein that is open in the axial direction relative to said second shaft, and a periphery that is directed toward said peripheral surface of said first roller, wherein said first and second rollers are disposed on either side of said path and resiliently engage a carrier moving along said path, with the uncoated side of the carrier facing said second roller, to provide a carrier passage gap between said first and second rollers, the dimension of said gap along a line perpendicular to said first and second shafts being changeable to accommodate carriers having different thicknesses, and wherein said first portions are of hemispherical configuration.

6. A conveying system for passing a web- or sheet-shaped photographic layer-bearing carrier along a path through the photochemical baths of a developing apparatus, the carrier having an uncoated side, comprising:

at least one set of parallel conveying rollers, at least one roller of each set being driven, each set of rollers including a first roller having a first shaft and a peripheral surface, and a second roller having a second shaft and a plurality of pressure elements rotatably mounted one behind the other on said second shaft, said elements being resiliently yielding in the radial direction with regard to said second shaft, each element having a first portion with a convex side, a concave side with a cavity therein that is open in the axial direction relative to said second shaft, and a periphery that is directed toward said peripheral surface of said first roller, wherein said first and second rollers are disposed on either side of said path and resiliently engage a carrier moving along said path, with the uncoated side of the carrier facing said second roller, to provide a carrier passage gap between said first and second rollers, the dimension of said gap along a line perpendicular to said first and second shafts being changeable to accommodate carriers having different thicknesses, and wherein said first portions are of conical configuration.

7. A conveying system for passing a web- or sheet-shaped photographic layer-bearing carrier along a path through the photochemical baths of a developing apparatus, the carrier having an uncoated side, comprising:

at least one set of parallel conveying rollers, at least one roller of each set being driven, each set of rollers including a first roller having a first shaft and a peripheral surface, and a second roller having a second shaft and a plurality of pressure elements rotatably mounted one behind the other on said second shaft, said elements being resiliently yielding in the radial direction with regard to said second shaft, each element having a first portion with a convex side, a concave side with a cavity therein that is open in the axial direction relative to said second shaft, and a periphery that is directed toward said peripheral surface of said first roller, wherein said first and second rollers are disposed on either side of said path and resiliently engage a carrier moving along said path, with the uncoated side of the carrier facing said second roller, to provide a carrier passage gap between said first and second rollers, the dimension of said gap along a line perpendicular to said first and second shafts being changeable to accommodate carriers having different thicknesses, and wherein a number of said pressure elements have their cavities open toward one end of said second shaft, and an equal number of said pressure elements have their cavities open toward the other end of said second shaft.

8. A conveying system for passing a web- or sheet-shaped photographic layer-bearing carrier along a path through the photochemical baths of a developing apparatus, the carrier having an uncoated side, comprising:

at least one set of parallel conveying rollers, at least one roller of each set being driven, each set of rollers including a first roller having a first shaft and a peripheral surface, and a second roller having a second shaft and a plurality of pressure elements rotatably mounted one behind the other on said second shaft, said elements being resiliently yielding in the radial direction with regard to said second shaft, each element having a first portion with a convex side, a concave side with a cavity therein that is open in the axial direction relative to said second shaft, and a periphery that is directed toward said peripheral surface of said first roller, wherein said first and second rollers are disposed on either side of said path and resiliently engage a carrier moving along said path, with the uncoated side of the carrier facing said second roller, to provide a carrier passage gap between said first and second rollers, the dimension of said gap along a line perpendicular to said first and second shafts being changeable to accommodate carriers having different thicknesses, and wherein every two pressure elements are arranged in pairs on said second shaft, the two elements of each such pair having the open ends of their cavities facing toward each other.

9. A conveying system for passing a web- or sheet-shaped photographic layer-bearing carrier along a path through the photochemical baths of a developing apparatus, the carrier having an uncoated side, comprising:

at least one set of parallel conveying rollers, at least one roller of each set being driven, each set of rollers including a first roller having a first shaft and a peripheral surface, and a second roller having a second shaft and a plurality of pressure elements rotatably mounted one behind the other on said second shaft, said elements being resiliently yielding in the radial direction with regard to said second shaft, each element having a first portion with a convex side, a concave side with a cavity therein that is open in the axial direction relative to said second shaft, and a periphery that is directed toward said peripheral surface of said first roller, wherein said first and second rollers are disposed on either side of said path and resiliently engage a carrier moving along said path, with the uncoated side of the carrier facing said second roller, to provide a carrier passage gap between said first and second rollers, the dimension of said gap along a line perpendicular to said first and second shafts being changeable to accommodate carriers having different thicknesses, and wherein said first portion comprises an elastically deformable annular zone of accordion-type folded configuration.

10. A conveying system for passing a web- or sheet-shaped photographic layer-bearing carrier along a path through the photochemical baths of a developing apparatus, the carrier having an uncoated side, comprising:

at least two roller trio units of conveying rollers, adjacent units being spaced apart by transition zones and at least one roller of each unit being driven, each unit including a first roller having a first shaft and a peripheral surface, a second roller spaced apart from said first roller, said second roller having a second shaft and a peripheral surface, said second shaft being parallel to said first shaft and lying in a common plane therewith, and a third roller disposed between said first and second rollers, said third roller having a third shaft that is parallel to said first and second shafts and that lies in said common plane, said third roller additionally having a plurality of pressure elements rotatably mounted one behind the other on said third shaft, said elements being resiliently yielding in the radial direction with regard to said third shaft and having peripheries that are directed toward said peripheral surfaces of said first and second rollers; and guide element means for supporting a carrier in said transition zones and guiding the carrier along said path to the next roller trio unit, wherein said path runs between the first and third rollers of each roller trio unit and between the second and third rollers of each roller trio unit, with the rollers of each trio unit being disposed so that the common plane thereof is transverse to said path and so that the rollers thereof resiliently engage a carrier moving along said path, with the uncoated side of the carrier facing said third roller, to provide carrier passage gaps between said first and third rollers and between said second and third rollers, the dimensions of said gaps along a line perpendicular to said shafts being changeable to accommodate carriers having different thicknesses, and wherein said guide element means comprises a plurality of guiding elements, each of said guiding elements extending in a plane transversely to the third shafts and between two adjacent pressure elements on each third shaft.

11. A conveying system for passing a web- or sheet-shaped photographic layer-bearing carrier along a path through the photochemical baths of a developing apparatus, the carrier having an uncoated side, comprising:

at least two roller trio units of conveying rollers, adjacent units being spaced apart by transition zones and at least one roller of each unit being driven, each unit including a first roller having a first shaft and a peripheral surface, a second roller spaced apart from said first roller, said second roller having a second shaft and a peripheral surface, said second shaft being parallel to said first shaft and lying in a common plane therewith, and a third roller disposed between said first and second rollers, said third roller having a third shaft that is parallel to said first and second shafts and that lies in said common plane, said third roller additionally having a plurality of pressure elements rotatably mounted one behind the other on said third shaft, said elements being resiliently yielding in the radial direction with regard to said third shaft and having peripheries that are directed toward said peripheral surfaces of said first and second rollers; and guide element means for supporting a carrier in said transition zones and guiding the carrier along said path to the next roller trio unit, wherein said path runs between the first and third rollers of each roller trio unit and between the second and third rollers of each roller trio unit, with the rollers of each trio unit being disposed so that the common plane thereof is transverse to said path and so that the rollers thereof resiliently engage a carrier moving along said path, with the uncoated side of the carrier facing said third roller, to provide carrier passage gaps between said first and third rollers and between said second and third rollers, the dimensions of said gaps along a line perpendicular to said shafts being changeable to accommodate carriers having different thicknesses, and wherein said guide element means comprises a plurality of elongated guiding elements, with each of said third rollers being traversed, between the pressure elements thereof, by two of said guiding elements, one thereof passing adjacent the first roller of the respective roller trio unit and the other passing adjacent the second roller of the respective roller trio unit roller, parallel to said path and between said passage gaps and the respective third shafts.

12. A conveying system for passing a web- or sheet-shaped photographic layer-bearing carrier along a path through the photochemical baths of a developing apparatus, the carrier having an uncoated side, comprising:

at least two roller trio units of conveying rollers, adjacent units being spaced apart by transition zones and at least one roller of each unit being driven, each unit including a first roller having a first shaft and a peripheral surface, a second roller spaced apart from said first roller, said second roller having a second shaft and a peripheral surface, said second shaft being parallel to said first shaft and lying in a common plane therewith, and a third roller disposed between said first and second rollers, said third roller having a third shaft that is parallel to said first and second shafts and that lies in said common plane, said third roller additionally having a plurality of pressure elements rotatably mounted one behind the other on said third shaft, said elements being resiliently yielding in the radial direction with regard to said third shaft and having peripheries that are directed toward said peripheral surfaces of said first and second rollers; and guide element means for supporting a carrier in said transition zones and guiding the carrier along said path to the next roller trio unit, wherein said path runs between the first and third rollers of each roller trio unit and between the second and third rollers of each roller trio unit, with the rollers of each trio unit being disposed so that the common plane thereof is transverse to said path and so that the rollers thereof resiliently engage a carrier moving along said path, with the uncoated side of the carrier facing said third roller, to provide carrier passage gaps between said first and third rollers and between said second and third rollers, the dimensions of said gaps along a line perpendicular to said shafts being changeable to accommodate carriers having different thicknesses, and wherein a plurality of roller trio units are stacked one above the other and said path is U-shaped, said system further comprising a rack adapted for conveying said photographic layer-bearing carriers along said U-shaped path through said photochemical bath, all of said roller trio units being supported in said rack, and wherein said guide element means comprises a plurality of guiding elements, a first pair of which passes between pressure elements on said third rollers of said units on the side of a descending leg of said U-shaped path and a second pair of which passes between pressure elements on said third rollers of said units on the side of an ascending leg of said U-shaped path.

13. The conveying system of claim 12, wherein one guiding element of the pair of guiding elements on the side of the descending leg of said U-shaped path and a corresponding guiding element of the pair of guiding elements on the side of the ascending leg of said path, are devised integral so as to constitute a single U-shaped rod, and the other guiding elements of the two pairs are integral with each other, being a similar U-shaped rod.

14. The conveying system of claim 13, wherein the closed ends of said U-shaped guiding elements are at a top end of said system, which system further comprises means for fastening said closed U-shaped ends at said top end of said system.

* * * * *